US007845952B2

(12) United States Patent
Gall

(10) Patent No.: US 7,845,952 B2
(45) Date of Patent: Dec. 7, 2010

(54) DETACHABLE MAGNETIC GROUND STRAP ASSEMBLY

(75) Inventor: Michael R. Gall, Cordova, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 12/433,941

(22) Filed: May 1, 2009

(65) Prior Publication Data

US 2009/0280655 A1 Nov. 12, 2009

Related U.S. Application Data

(60) Provisional application No. 61/052,331, filed on May 12, 2008.

(51) Int. Cl.
*H01R 11/30* (2006.01)
*H01R 13/60* (2006.01)

(52) U.S. Cl. ..... 439/38; 439/95; 439/100

(58) Field of Classification Search ..... 439/95, 439/38–40, 100

See application file for complete search history.

(56) References Cited

U.S. PATENT DOCUMENTS

| | | | |
|---|---|---|---|
| 3,980,915 | A | 9/1976 | Chapman et al. |
| 4,008,937 | A | 2/1977 | Filippi |
| RE29,752 | E | 9/1978 | Jaconette, Jr. |
| 4,250,350 | A | 2/1981 | Polimine |
| 4,346,428 | A | 8/1982 | Gale |
| 4,487,462 | A | 12/1984 | Gale et al. |
| 4,588,468 | A | 5/1986 | McGinty et al. |
| 4,808,117 | A | 2/1989 | Gale et al. |
| 4,816,956 | A | 3/1989 | Hertz et al. |
| 4,881,760 | A | 11/1989 | Runkles et al. |
| 4,900,070 | A | 2/1990 | Runkles et al. |
| 4,928,202 | A | 5/1990 | Gale et al. |
| 5,030,931 | A | 7/1991 | Brooks et al. |
| 5,120,960 | A | 6/1992 | Halvis |
| 5,166,861 | A | 11/1992 | Krom |
| 5,173,766 | A | 12/1992 | Long et al. |
| 5,188,400 | A | 2/1993 | Riley et al. |
| 5,434,360 | A | 7/1995 | Ehrenfels |
| 5,480,311 | A | 1/1996 | Luu |
| 5,620,210 | A | 4/1997 | Eyster et al. |
| 5,749,740 | A | 5/1998 | Swift et al. |
| 5,786,976 | A | 7/1998 | Field |
| 5,929,383 | A | 7/1999 | Marik et al. |
| 5,959,828 | A | 9/1999 | Lewis et al. |
| 6,074,121 | A | 6/2000 | Medeiros et al. |
| 6,172,298 | B1 | 1/2001 | Norvelle |
| 6,283,767 | B1 * | 9/2001 | Sornes ..... 439/39 |
| 6,290,511 | B1 | 9/2001 | Edwards et al. |
| 6,734,360 | B2 | 5/2004 | Magno |
| 6,804,093 | B2 | 10/2004 | Buie, Jr. |
| 6,848,720 | B2 | 2/2005 | Carns et al. |
| 6,880,859 | B2 | 4/2005 | Breay et al. |
| 6,883,836 | B2 | 4/2005 | Breay et al. |

* cited by examiner

*Primary Examiner*—Javaid Nasri
(74) *Attorney, Agent, or Firm*—Hoffmann & Baron, LLP

(57) ABSTRACT

A ground strap assembly couples two conductive components of a utility structure. The ground strap assembly includes an elongate electrically conductive ground strap having opposed ends. A pair of attachment members are mechanically and electrically coupled to each end of the strap. Each attachment member has a magnetic surface so that the ends of the strap may be placed in removable magnetic attachment to the two components to establish ground continuity across the components.

10 Claims, 4 Drawing Sheets

DETACHABLE MAGNETIC GROUND STRAP ASSEMBLY

CROSS REFERENCE TO RELATED APPLICATIONS

This application claims priority to U.S. Provisional Patent Application No. 61/052,331 filed on May 12, 2008, the contents of which is incorporated herein by reference in its entirety.

FIELD OF THE INVENTION

The present invention relates generally to a ground strap for electrically coupling interconnected components of a utility structure. More particularly, the present invention relates to a ground strap which can be connected to components of the utility structure magnetically.

BACKGROUND OF THE INVENTION

Various structures such as engineered poles, utility structures, frames, lattice structures and the like are used to support electrical and communication cables outdoors. Certain of these structures support high voltage cables. Safety concerns dictate that these structures be suitably electrically grounded. Quite often, these structures are formed of multiple interconnected components, such as for example, multi-piece attachable vertical poles and horizontally extending arms which support the actual cable. In order to assure that electrical ground continuity is established across the multiple components, a ground strap is employed to electrically interconnect one component to the adjacent component. Thus, the ground strap provides the primary ground connection between components rather than relying upon the physical mechanical interconnections between the components.

Moreover, certain utility code requirements include provisions for such additional grounding. Typically, such additional grounding provisions, if added to existing structures, require physical attachment of the ground strap to the components of the structure itself. This often requires either welding ground pads to the structure or attaching the ground pads with securement hardware such as nuts and bolts.

As may be appreciated, such attachment is a time consuming and costly endeavor. Also, in the case of painted or galvanized structures, the attachment of the grounding strap by welding and the like could cause damage to the protective coating placed on the structure. This would require additional application of a coating to the structure to replace the damage done by attachment of the ground strap.

It is, therefore, desirable to provide a simple mechanism for attaching a ground strap across components of a utility structure.

SUMMARY OF THE INVENTION

The present invention provides a ground strap assembly for electrically coupling two components of a structure. The assembly includes an elongate electrically conductive ground strap having opposed ends. One of a pair of attachment members is electrically and mechanically coupled to each of the strap ends. The attachment members each have a magnetic surface for removable magnetic coupling to the components of the structure so as to establish ground continuity across the components.

In a preferred embodiment, the ground strap is a flexible member.

DETAILED DESCRIPTION OF THE PREFERRED EMBODIMENT

The present invention provides a ground strap assembly for electrically coupling separate interconnected components of a structure.

Figure 1:
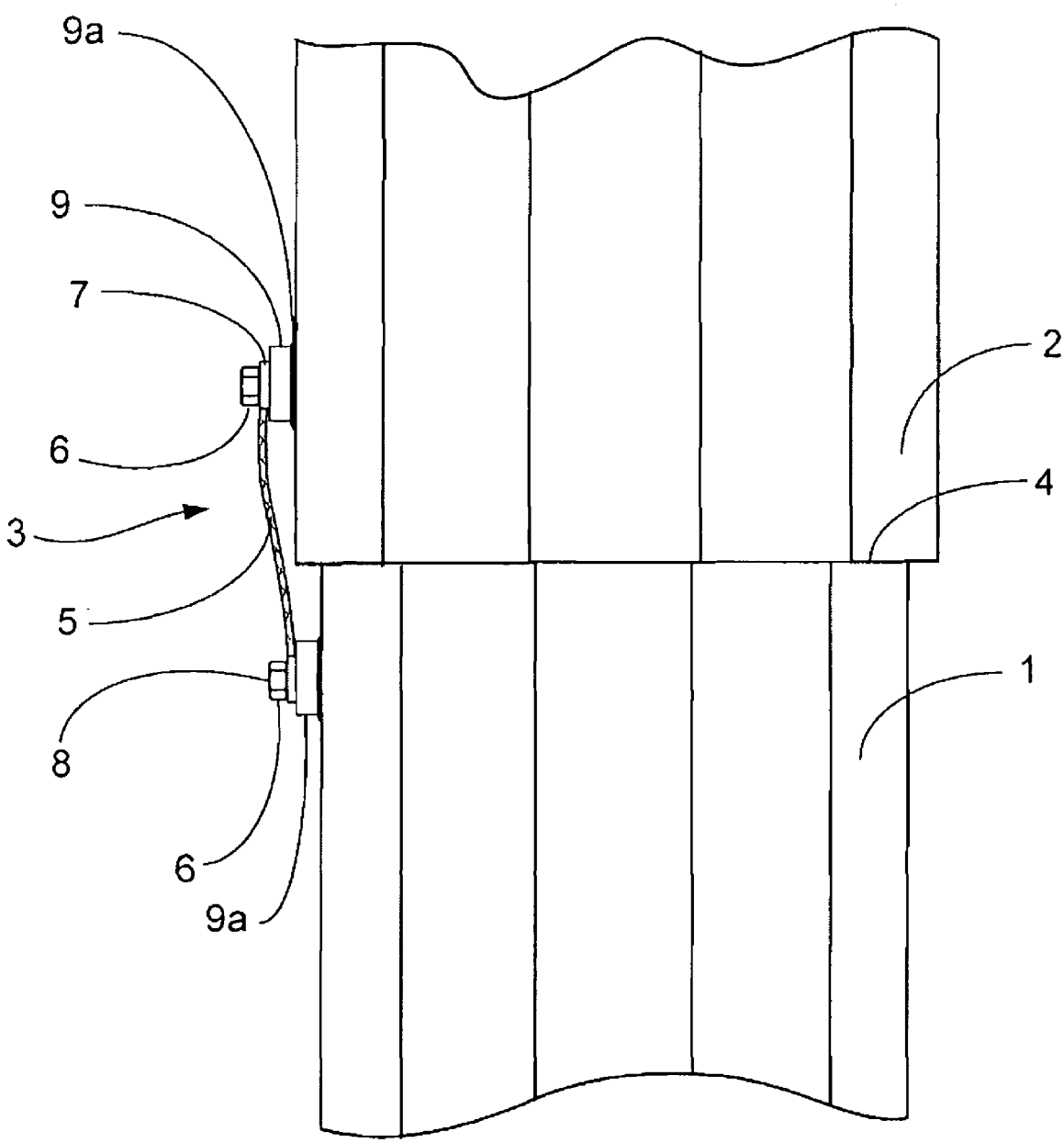
FIG. 1 (PRIOR ART)
FIG. 1 shows a portion of a two-component coupled utility structure of the prior art including a ground strap attached thereto electrically coupling the two components.

Referring to FIG. 1, two components, 1 and 2 of a utility structure, such as an engineered pole, frame, lattice or steel structure, may be interconnected by a slip or mechanical coupling. Such utility structures are typically formed of conductive materials such as metal. While such a coupling may provide mechanical and electrical engagement between the two components, a ground strap assembly 3 is typically employed to assure that electrical ground continuity is established across the joined location 4. The ground strap assembly 3 may include an elongate electrically conductive strap 5 having connector assemblies 6 at either end thereof. Each connection assembly includes a connector 7 and a ground pad 9. The connector 7 is secured to the ground pad 9 by a bolt 8. A ground pad 9 is attached to the components 1 and 2 of the structure in an electrically conductive manner. For example, weldments 9*a* may be employed. Welding the ground pads 9 in this fashion assures that mechanical and electrical engagement is maintained between the components 1 and 2 across flexible strap 5. As may be appreciated, however, such welding connection is both time consuming and costly.

Figure 3:
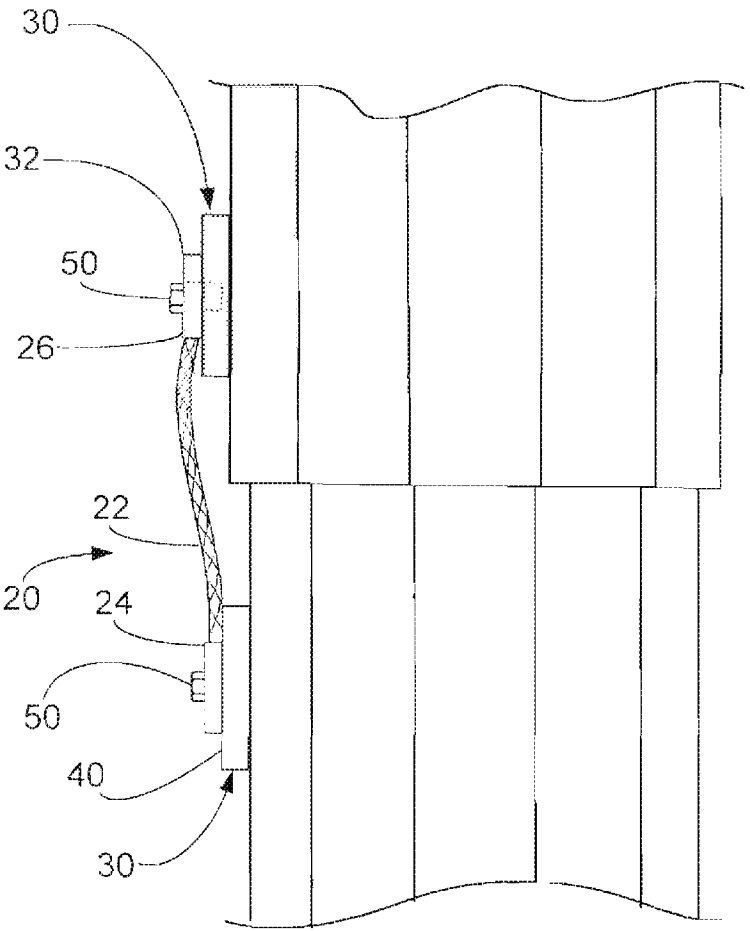
FIGS. 2 and 3 are front and side views of a portion of a two component structure including a ground strap of the present invention electrically coupling the components.
Figure 2:
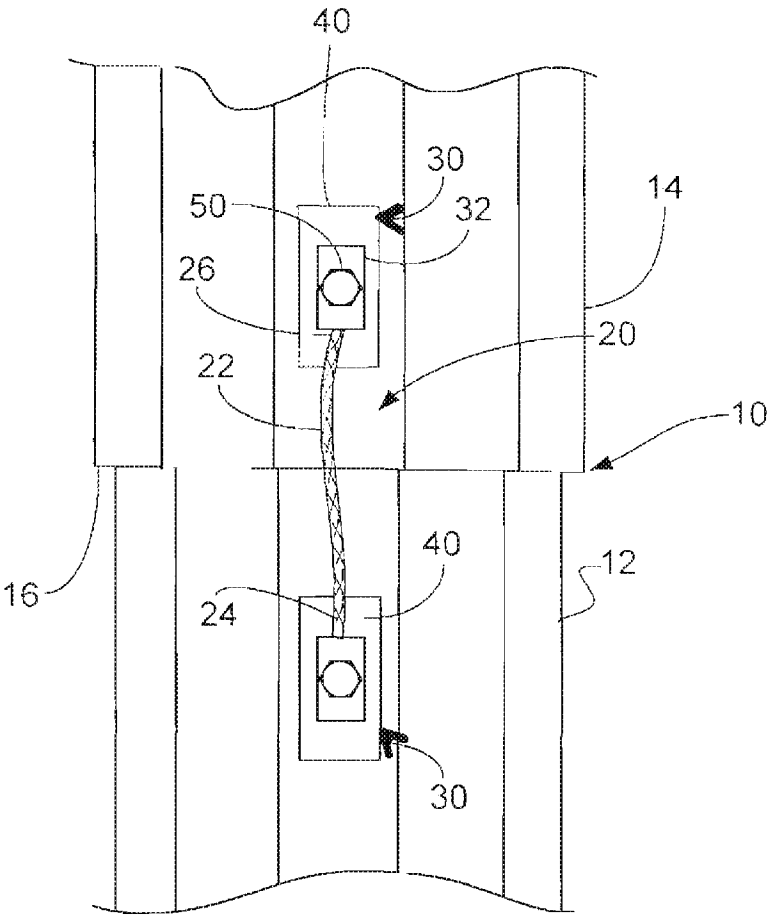

Referring now to FIGS. 2 and 3, the improved ground strap assembly of the present invention is shown.

A multi-component utility structure 10 includes at least two components 12 and 14 coupled at a coupling location 16. Structure 10 may be an electrically conductive pole commonly used in utility applications. In order to ensure adequate electrical continuity between the components 12 and 14 across the connection location 16, a ground strap assembly 20 is employed. Ground strap assembly 20 includes an elongate electrically conductive ground strap 22 having opposed ends 24 and 26. The ground strap 22 is typically a flexible braided member formed of electrically conductive material. However, other strap components may be employed, including insulated and uninsulated electrical cable.

Figure 4:
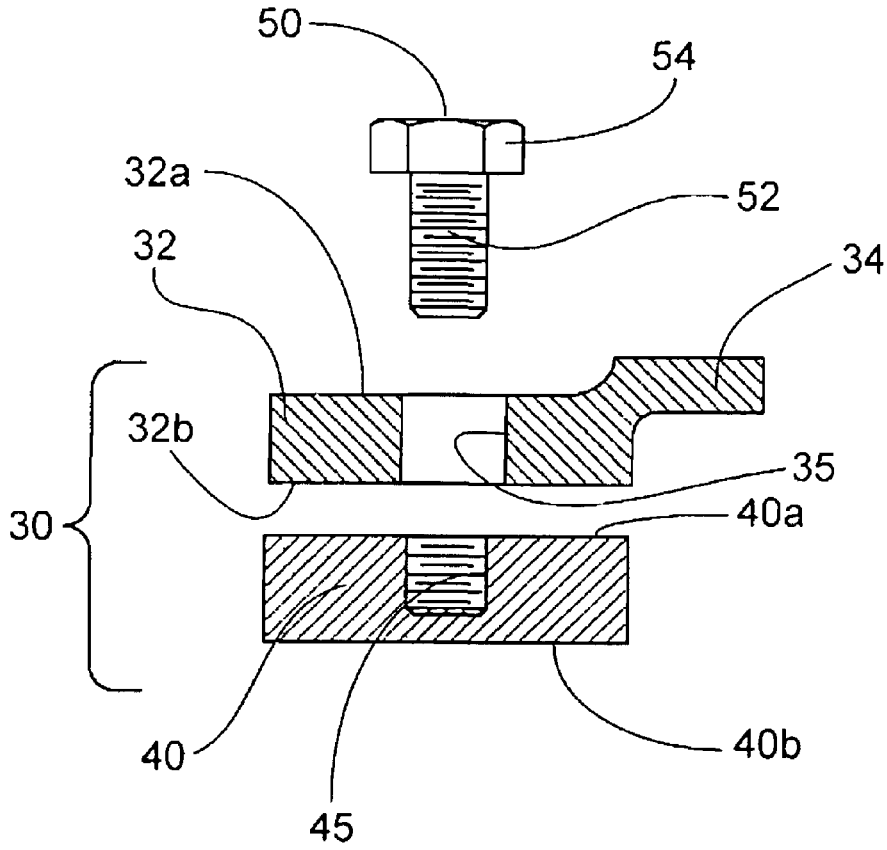
FIG. 4 shows an exploded partially sectioned view, of one embodiment of a connector used in the ground strap of FIGS. 2 and 3.

Each end 24 and 26 of strap 22 is terminated with an attachment member 30. One type of attachment member is shown in more detail in FIG. 4. Attachment member 30 may include an electrical connector 32 which is an electrically conductive generally planar member having an upper surface 32*a* and a lower surface 32*b*. The connector 32 has a barrel portion 34 extending therefrom for accommodating the ends 24, 26 of ground strap 22. The barrel portion 34 may be crimped connected or otherwise suitably mechanically and electrically coupled to the ends 24, 26 of ground strap 22 in methods well known in the art.

Attachment member 30 further includes a planar ground pad 40 having an upper surface 40*a* and opposed lower surface 40*b*. In the embodiment shown in FIG. 4, the ground pad 40 is co-extensive with the transverse and longitudinal extents of the planar portion of connector 32. However, as shown in FIGS. 2 and 3, the ground pad 40 may extend outwardly in both a longitudinal and transverse dimension therefrom.

A conductive bolt 50 may be used to couple connector 32 to ground pad 40. Bolt 50 is a conventional externally threaded conductive bolt having a threaded shaft 52 and a hex head 54 at one end thereof. In order to provide such coupling, connector 32 has a centrally located aperture 35 therethrough, which optionally may be threaded, and which receives the thread shaft 52 of bolt 50. Furthermore, ground pad 40 includes a centrally located internally threaded cavity 45 for threadingly accommodating the end of shaft 52. As may be appreciated, the threaded insertion of bolt 50 through aperture 35 and into cavity 45 mechanically and electrically couples the connector 32 to ground pad 40.

Figure 5:
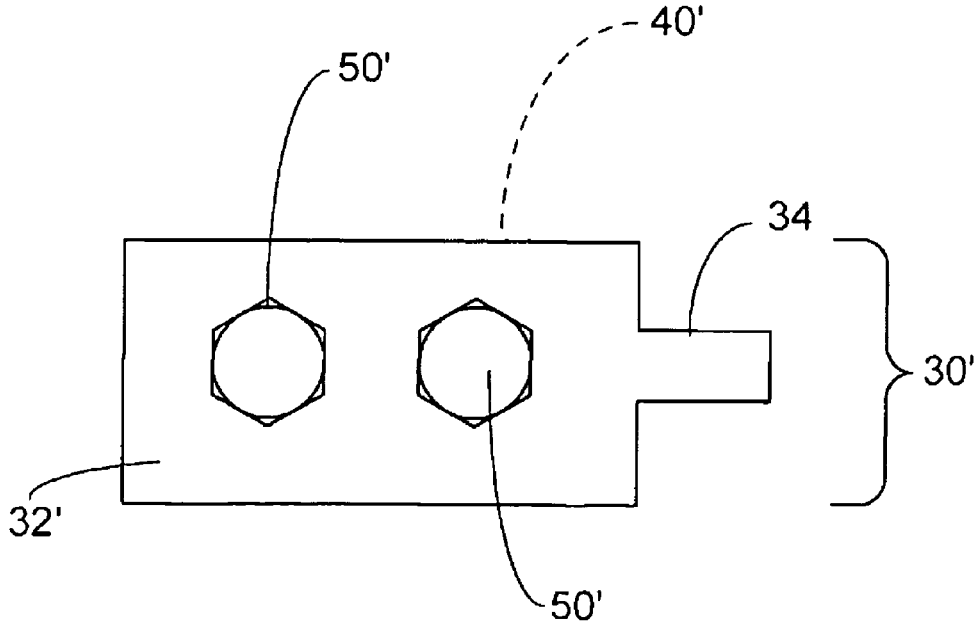
FIG. 5 is a top plan view of a further embodiment of the connector of the present invention.

FIG. 5 shows a further embodiment of the attachment member 30' where two bolts 50' are employed to attach connector 32' to ground pad 40'. Other configurations, shapes and arrangements are also within the contemplation of the present invention.

As may be appreciated, the bolt 50, connector 32 and ground pad 40 are formed from electrically conductive material so as to provide electrical continuity between both attachment assemblies coupled to the opposite ends of ground strap 22. However, in the present invention, ground pad 40 is specifically formed of magnetic conductive material. Such magnetic conductive material magnetically couples to the metal components 12 and 14 of structure 10. By employing a magnetic ground pad, mechanically and electrically coupled to the ends of ground strap 22, the ground strap assembly 20 may be simply and easily placed on the structure across joint 16. This results in securement of the ground strap assembly 20 and assures ground continuity across the connection location 16.

As may be appreciated, an installer need only place the ground pad 40 of the attachment member 30 on the structure 10 spanning connection location 16. The magnetic ground pad 40 easily self attaches to the structure. This avoids welding or other attachment techniques which are both costly and time consuming.

Figure 6:
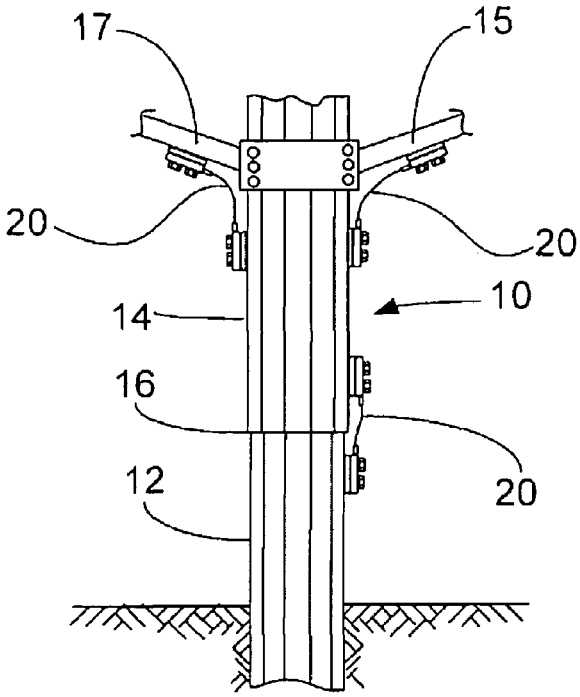
FIGS. 6 and 7 show an multi-component structure including ground straps of the present invention used to electrically couple the components.

As shown in FIG. 6, the ground strap 20 of the present invention may be used to assure ground continuity between two elongate components 12 and 14 of a structure 10. However, the ground strap assembly 20 may also be used to assure electrical continuity between one of the components 14 and support arms 15 and 17 which extend therefrom.

Figure 7:
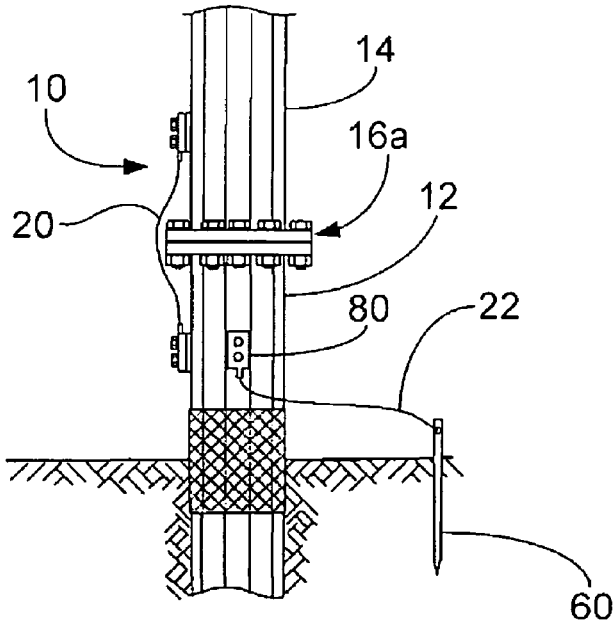

Referring to FIG. 7, the ground strap assembly 20 of the present invention may be used to assure electrical continuity between two components 12 and 14 of a structure 10 even across a bolted connection 16*a* therebetween.

Still further, one attachment member 30 of the present invention may be coupled to a ground strap 22 at one end thereof where the other end of the ground strap is coupled to a ground rod 60 so as to assure common ground for the structure 10.

While the invention has been described in related to the preferred embodiments with several examples, it will be understood by those skilled in the art that various changes may be made without deviating from the fundamental nature and scope of the invention as defined in the appended claims.

What is claimed is:

1. A ground strap assembly for electrically coupling two conductive components of a structure comprising:

an elongate electrically conductive ground strap having opposed ends; and a pair of attachment members one being mechanically and electrically coupled to each end of said strap, each said attachment member having a magnetic ground pad for removable magnetic coupling to each of said two components of said structure so as to provide ground continuity across said components said ground strap being non-movably fixed to said magnetic ground pad.

2. An assembly of claim 1 wherein said ground strap is flexible.

3. An assembly of claim 1 wherein each said attachment member includes an electrical connector terminating each end of said ground strap.

4. An assembly of claim 3 wherein each said connector is mechanically and electrically attachable to said ground pad.

5. An assembly of claim 4 wherein each said electrical connector includes an extending barrel portion for termination to an end of said ground strap.

6. An assembly of claim 4 wherein each said electrical connector is bolted to said ground pad.

7. A method of electrically connecting a pair of coupled components of a conductive structure comprising the steps of:

providing an elongate flexible ground strap;

providing a pair of attachment members each having a magnetic ground pad, non-movably affixing each end of said ground strap to one of said magnetic ground pads; and magnetically coupling each said ground pad to said pair of coupled components.

8. A method of claim 7 wherein said non-movably affixing step further includes:

attaching an electrical connector to each end of said ground strap.

9. A method of claim 8 wherein said non-movably affixing step further includes:

attaching said connector to said ground pad.

10. A method of claim 9 wherein said attaching step includes:

bolting said connector to said ground pad.

* * * * *